US007137862B2

(12) United States Patent
Arnold

(10) Patent No.: US 7,137,862 B2
(45) Date of Patent: Nov. 21, 2006

(54) SYSTEM AND METHOD FOR CONTROLLING MULTIPLE MODEL VEHICLES

(76) Inventor: L. Taylor Arnold, P.O. Box 12387, Durham, NC (US) 27709

( * ) Notice: Subject to any disclaimer, the term of this patent is extended or adjusted under 35 U.S.C. 154(b) by 0 days.

(21) Appl. No.: 10/646,120

(22) Filed: Aug. 25, 2003

(65) Prior Publication Data

US 2005/0048870 A1 Mar. 3, 2005

(51) Int. Cl.
*A63H 18/14* (2006.01)

(52) U.S. Cl. ..... 446/445; 446/454; 446/457; 463/62

(58) Field of Classification Search ..... 446/454–456, 446/450–452, 444–446, 457; 463/58, 1, 463/62

See application file for complete search history.

(56) References Cited

U.S. PATENT DOCUMENTS 1,804,257 A * 5/1931 Greenley ..... 180/14.2
1,931,139 A * 10/1933 Warren ..... 446/451
2,782,559 A * 2/1957 Strauss ..... 446/451
4,508,517 A * 4/1985 Kulesza ..... 446/464
4,568,300 A * 2/1986 Rasmussen et al. ..... 446/129
4,938,483 A * 7/1990 Yavetz ..... 463/5
4,940,442 A * 7/1990 Matsuda ..... 446/90
5,100,153 A * 3/1992 Welte ..... 273/357
5,749,547 A * 5/1998 Young et al. ..... 246/4
6,491,566 B1 12/2002 Peters et al. ..... 446/454
6,674,259 B1 * 1/2004 Norman et al. ..... 318/568.11
2003/0082987 A1 * 5/2003 Baumgartner et al. ..... 446/175

FOREIGN PATENT DOCUMENTS

GB 2207364 A * 2/1989

* cited by examiner

*Primary Examiner*—Bena Miller
(74) *Attorney, Agent, or Firm*—LaMorte & Associates

(57) ABSTRACT

A system and method for controlling multiple model vehicles while using only a single remote control transmitter. A remote control signal transmitter is provided for transmitting control signals. The transmitted control signals are received by a single master model vehicle. The master model vehicle contains a remote control signal receiver and various motors that enable the master model vehicle to move along a first pathway in response to the control signals that are received. At least one slave model vehicle is provided that is coupled to the master model vehicle. The slave model vehicle(s) contain no motors but are rather propelled by the master model vehicle. Each slave model vehicle does not travel along the same pathway as the master model vehicle, but rather travels in formation in pathways that are adjacent to the pathway of the master model vehicle.

8 Claims, 4 Drawing Sheets

SYSTEM AND METHOD FOR CONTROLLING MULTIPLE MODEL VEHICLES

BACKGROUND OF THE INVENTION

1. Field of the Invention

In general, the present invention relates to remote control systems for model cars, airplanes and boats. More specifically, the present invention relates to remote control systems where multiple model vehicles are simultaneously controlled by a single user using a single remote control signal transmitter and receiver.

2. Description of the Prior Art

There are many model vehicles that can be controlled by remote control signals. In most any toy store or model shop, a person can find model cars, trucks, airplanes, boats and mobile robots that can be controlled by a remote control signal transmitter. However, in most all cases, each model vehicle comes with a single dedicated remote control transmitter. As such, there is a one-to-one ratio between the number of remote control vehicles and the number of remote control signal transmitters.

In the prior art, there have been remote control vehicle systems developed that enable a single person to operate different vehicles. For example, in U.S. Pat. No. 4,938,483 to Yavetz, entitled Multiple-Vehicle Interactive Toy, a system is disclosed where a user can control different vehicles using a single remote control signal transmitter. However, each of the multiple vehicles contains a remote control signal receiver. The sole signal transmitter can be selectively cycled between the different vehicles. As such, the operator can only control one vehicle at a time, but the operator can change which vehicle is being controlled by the touch of a button.

U.S. Pat. No. 6,491,566 to Peters, entitled Sets Of Toy Robots Adapted To Act In Concert, Software And Methods Of Playing With The Same, shows a system where general commands are given to a computer by an operator. The computer generates multiple signals to different vehicles so that the vehicles act in unison. Again, each of the vehicles contains a remote control signal receiver.

With all of the prior art vehicle remote control systems, each vehicle that is to be controlled must contain its own remote control signal receiver and operational motors that can control the movement of the vehicle in accordance with the remote control signals that are received. Remote control signal receivers and steering mechanisms are complex assemblies that are expensive to manufacture. As such, a remote controlled vehicle tends to be much more expensive than an identical vehicle that does not contain any remotely controlled components.

A need therefore exists for a system and method where an operator can control the movement of multiple vehicles without having to provide each of the vehicles with expensive remotely controlled components. This need is met by the system and method of the present invention as described and claimed below.

SUMMARY OF THE INVENTION

A system and method are disclosed for controlling multiple model vehicles while using only a single remote control transmitter. In the system, a remote control signal transmitter is provided for transmitting control signals. The transmitted control signals are received by a single master model vehicle. The master model vehicle contains a remote control signal receiver and various motors that enable the master model vehicle to move along a first pathway in response to the control signals that are received.

At least one slave model vehicle is provided that is coupled to the master model vehicle. The slave model vehicle(s) contain no motors but are rather propelled by the master model vehicle. Each slave model vehicle does not travel along the same pathway as the master model vehicle, but rather travels in formation in pathways that are adjacent to the pathway of the master model vehicle. In this manner, a plurality of model vehicles can be caused to move in formation using only a single motorized vehicle and one remote signal receiver.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system can be applied to many types of remotely controlled model vehicles, such as airplanes, boats, trucks and the like, the present invention is particularly well suited for use with remote controlled model cars. Accordingly, and by way of example, the present invention system is illustrated as being applied to a set of model cars. It will be understood that such an embodiment is selected merely to set forth the best mode contemplated for the present invention and should not be considered a limitation on the scope of the invention. The present invention system can also be applied to other model vehicles, such as airplanes, boats, robots and the like. In fact, the term 'model vehicle' as used in the below specification and claims should be considered any model airplane, car, boat, truck or mobile robot.

Figure 1:
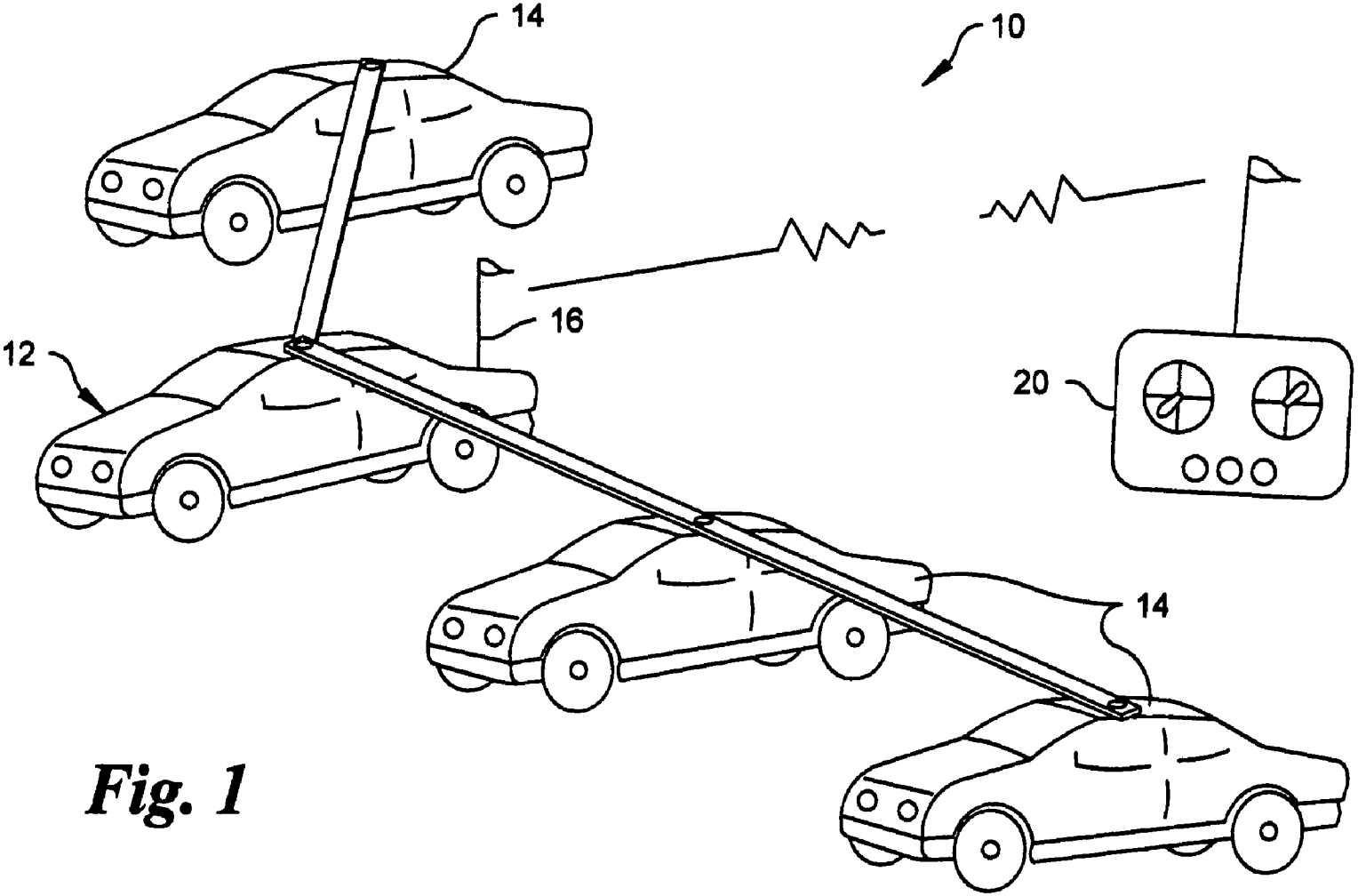
FIG. 1 is a perspective view of an exemplary embodiment of the present invention system.

Referring to FIG. 1, an exemplary embodiment of the present invention system 10 is shown. In the shown embodiment, a plurality of model vehicles are shown arranged in a formation. Although the shown embodiment shows four model vehicles, it should be understood that any plurality of model vehicles can be used.

In the formation of model vehicles, there is one master vehicle 12. The remaining vehicles are slave vehicles 14. The master vehicle 12 is a remote controlled vehicle capable of self-propulsion. The master vehicle 12 contains an antenna 16 and an internal remote control signal receiver. The master vehicle 12 also contains a drive motor for propelling the master vehicle 12 and other control servo motors used in the steering and control of the master vehicle 12. The drive motor and the control servo motors are all controlled by remote control signals received via the antenna 16 from a single remote control signal transmitter 20.

The remote control signal transmitter 20 is a typical transmitter containing controls for controlling the speed and direction of the master vehicle 12. The remote control signal transmitter 20 may also contain controls for operating various servo motors within the master vehicle 12, as will later be explained.

The slave vehicles 14 contain no motors of any kind, but merely are free moving vehicles. As such, they do not respond directly to signals from the remote control signal transmitter 20. In the shown embodiment of cars, the slave vehicles 14 each have four free rolling wheels. If the model vehicles were airplanes, the slave vehicles would be gliders. If the model vehicles were boats, the slave vehicles would have no propellers and would be free floating.

The master vehicle 12 is attached to the various slave vehicles 14 via a series of linkage elements. Accordingly, the master vehicle 12 moves all of the slave vehicles 14 and serves as the sole source of locomotion for the slave vehicles 14. Furthermore, since all of the slave vehicles 14 are directly or indirectly coupled to the master vehicle 12, the slave vehicles 14 move, stop and turn with the master vehicle 12. Accordingly, the slave vehicles 14 always move in formation with the master vehicle 12.

Each slave vehicle 14 can be attached to the master vehicle 12 with rigid linkages. If rigid linkages are used, the master vehicle 12 and the slave vehicles 14 travel together in an unchanging formation. However, the formation in which the slave vehicles 14 follow the master vehicle 12 need not be static. Rather, the formation of the slave vehicles 14 relative the master vehicle 12 can be varied by sending specific control signals to the master vehicle 12 via the remote control transmitter 20.

Figure 2:
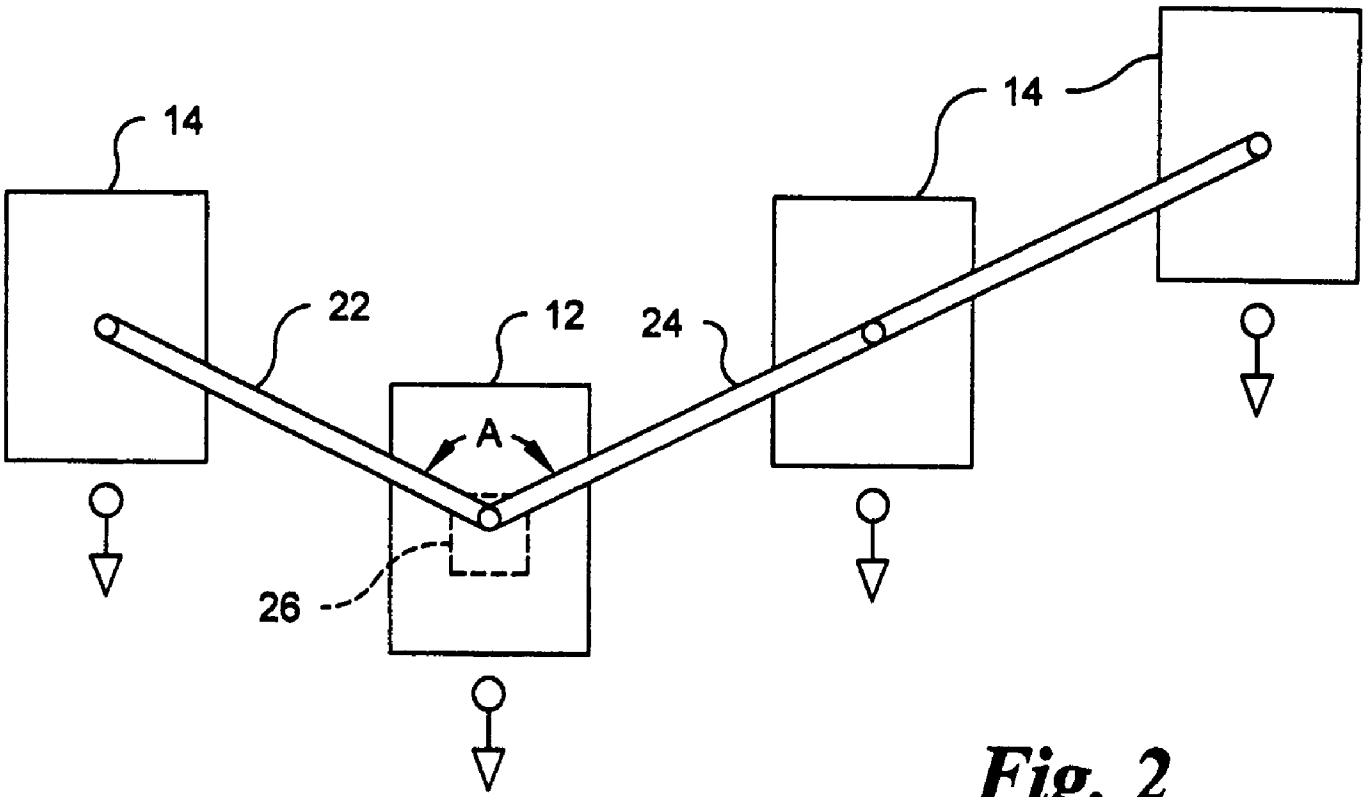
FIG. 2 is a top view of the linkage elements shown in FIG. 1 forming a first formation.

Referring to FIG. 2, it can be seen that one or more of the slave vehicles 14 can be attached to the master vehicle 12 using articulating linkage elements 22, 24. In FIG. 2, two linkage elements 22, 24 are shown. The two linkage elements 22, 24 diverge from the master vehicle 12 creating a divergence angle A between the linkage elements 22, 24. The two linkage elements 22, 24 are attached to a servo motor 26 that is controlled via remote control. The servo motor 26 alters the divergence angle A between the two linkage elements 22, 24 by symmetrically moving the linkage elements 22, 24 either apart or together.

Figure 3:
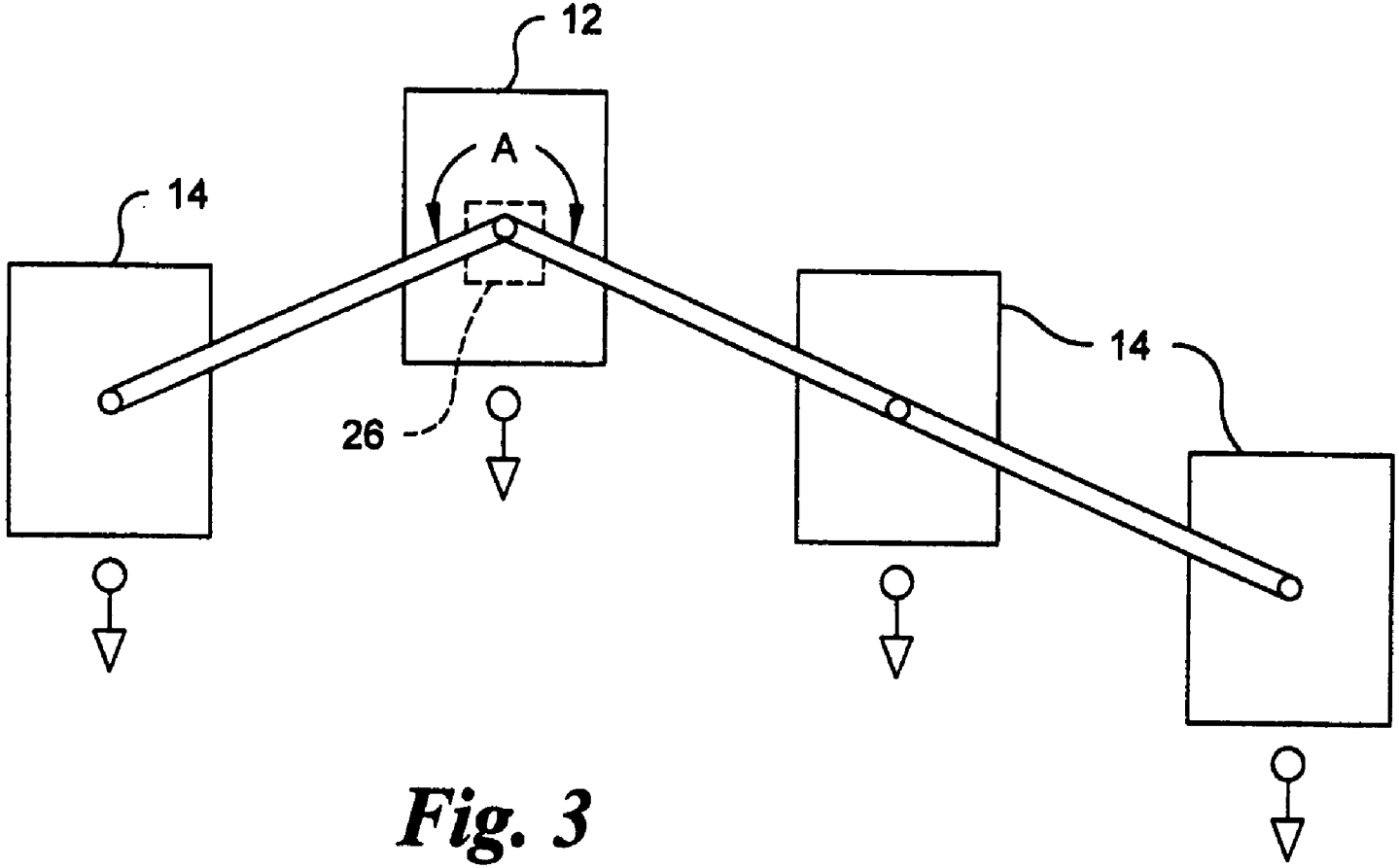
FIG. 3 is a top view of the linkage elements shown in FIG. 1 forming a second formation.

When the divergence angle A between the linkage elements 22, 24 is less than 180 degrees, the master vehicle 12 leads the slave vehicles 14 in the formation. However, as is shown by FIG. 3, when the divergence angle A between the linkage elements 22, 24 is greater than 180 degrees, the master vehicle 12 trails the slave vehicles 14 in formation. As such, by remotely controlling the servo motor 26 in the master vehicle 12, the master vehicle 12 can be made to lead the formation, trail the formation or be in a straight line with the formation.

Regardless of the formation, the master vehicle 12 travels along a first pathway. The slave vehicles 14 do not travel directly behind the master vehicle 12. Rather, the slave vehicles 14 travel to the sides of the master vehicle 12. The pathway of the slave vehicles 14 is therefore adjacent to the pathway of the master vehicle 12 as all the vehicles travel in formation.

In the embodiments of the present invention system previously described, there is one master vehicle and three slave vehicles. The slave vehicles are coupled to the master vehicle using only two linkage elements. It will be understood that such a configuration can be widely varied. One or any plurality of linkage elements can be attached to a servo motor in the master vehicle. Furthermore, linkage elements can extend from slave vehicles to other slave vehicles that never directly connect to the master vehicle. Such a configuration is illustrated in FIG. 4.

Figure 4:
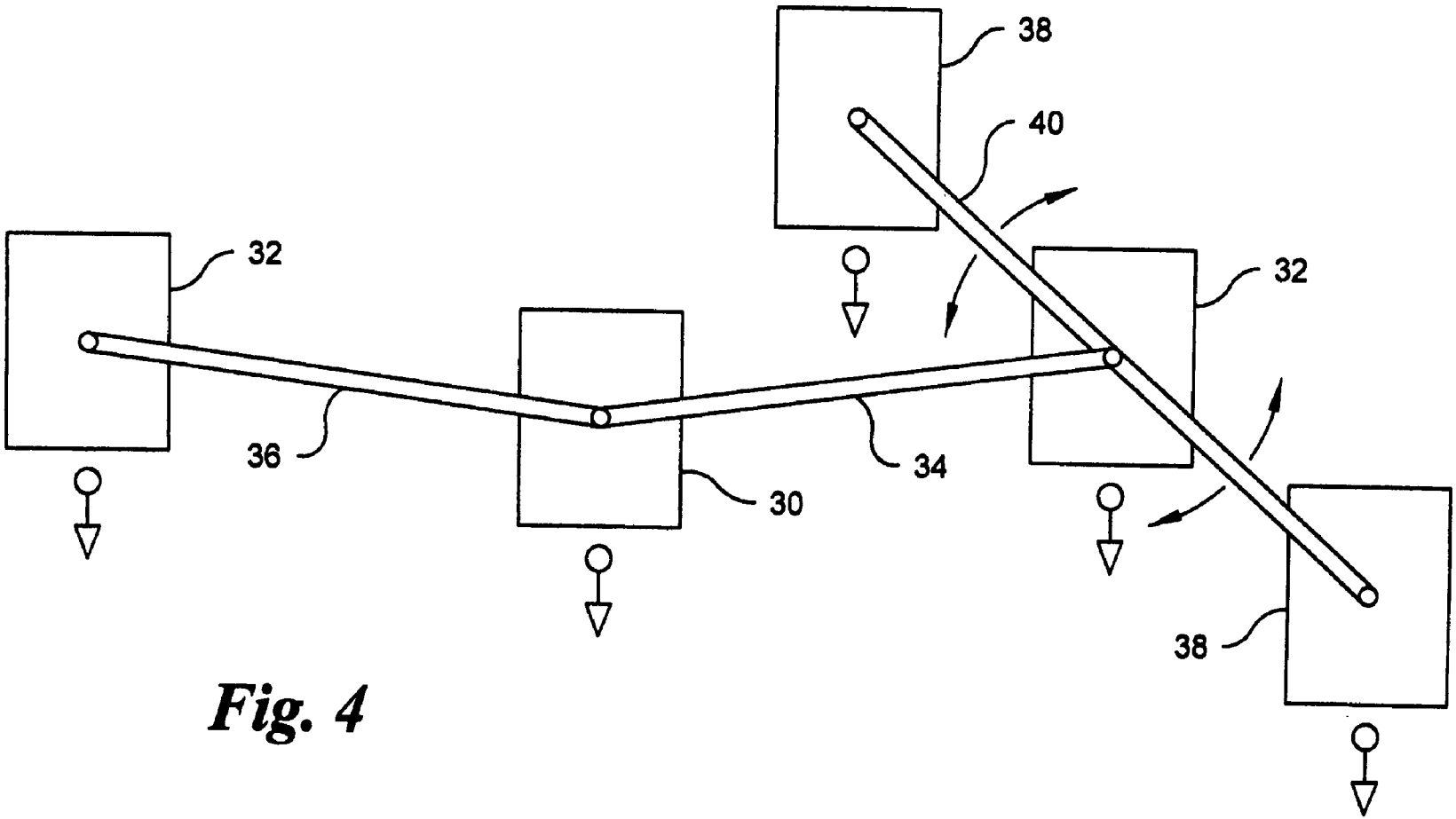
FIG. 4 is top view of an alternate embodiment of the present invention system.

Referring to FIG. 4, it can be seen that a master vehicle 30 is provided that is directly connected to primary slave vehicles 32 with linkage elements 34, 36. Secondary slave vehicles 38 are attached to the primary slave vehicle 32 with a secondary linkage element 40. As such, the secondary slave vehicles 38 are not directly linked to the master vehicle 30 but are only linked through a primary slave vehicle 32.

In the shown embodiment, the secondary slave vehicles 38 are disposed at the ends of a secondary linkage element 40 that is centrally connected with a pivot to a primary slave vehicle 32. As such, each of the secondary slave vehicles 38 are symmetrically disposed around the primary slave vehicle 32 and are free to rotate around the primary slave vehicle 32. Such a configuration prevents the secondary slave vehicles 38 from simply trailing behind the primary slave vehicle 32. By balancing the primary slave vehicle 32 between two secondary slave vehicles 38, the secondary slave vehicles 38 will move back and forth along the sides of the primary slave vehicle 32 as the master vehicle 30 moves forward. As one secondary slave vehicle 38 moves behind the primary slave vehicle 32, the other will advance. Thus, the movements of the secondary slave vehicles 38 will seem mostly random to the person controlling the master vehicle 30.

As is illustrated back in FIG. 1, the master vehicle 12 preferably has the same shape and appearance as do the slave vehicles 14. In this manner, a person viewing the formation of traveling vehicles cannot tell that only one of the vehicles is remotely controlled. Rather, all the vehicles appear relatively the same. Additionally, the different vehicles can be painted differently, so that the vehicles, while traveling in formation, can appear to be racing.

It will be understood that the embodiments of the present invention system that are described and illustrated herein are merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A remotely controlled toy vehicle system, comprising:

a remote control signal transmitter for transmitting control signals;

a master model vehicle containing a remote control signal receiver, wherein said master model vehicle is controlled by said control signals as it travels along a first pathway;

at least one slave model vehicle that is physically connected to said master model vehicle by at least one linkage element that extends from said master model vehicle at a predetermined angle, wherein said at least one slave model vehicle is oriented in a formation with said master model vehicle and is propelled in said formation by said master model vehicle along at least one second pathway that is separate and distinct from said first pathway of said master model vehicle; and a motor contained within said master model vehicle for selectively adjusting said predetermined angle, wherein motor is controlled by said remote controlled transmitter.

2. The system according to claim 1, wherein said formation is selectively adjustable by said remote control transmitter.

3. The system according to claim 1, having multiple slave model vehicles, wherein some of said slave model vehicles are interconnected to each other by secondary linkage elements that are not coupled to said master model vehicle.

4. The system according to claim 1, wherein said master model vehicle and said at least one slave model vehicle are selected from a group consisting of cars, trucks, planes boats and robots.

5. A method of moving a plurality of model vehicles in formation, comprising the steps of:

providing motors and a control system in a first model vehicle, wherein said first model vehicle travels in along a first pathway;

providing at least one linkage element that extends from said first model vehicle at a predetermined angle, wherein said predetermined angle can be selectively adjusted by remote control by one of said motors;

physically coupling a remainder of said plurality of model vehicles to said at least one linkage, wherein said remainder of said plurality of model vehicles are moved in a formation by said first model vehicle along at least one pathway that differs from to said first pathway of said first model vehicle.

6. The method according to claim 5, further including the step of selectively adjusting said formation as said remainder of said plurality of model vehicle are moved by said first model vehicle, by selectively adjusting said predetermined angle.

7. An assembly, comprising:

at least one linkage element;

a remotely controlled vehicle that moves along a first pathway as directed by remote control signals, wherein said at least one linkage element extends from said remotely controlled vehicle at a predetermined angle, and wherein said remotely controlled vehicle contains a motor that can selectively alter said predetermined angle; and at least one secondary vehicle physically connected to said at least one linkage element, wherein said at least one secondary vehicle is moved in formation by said remotely controlled vehicle along at least one secondary pathway that differs from said first pathway said remotely controlled vehicle.

8. The assembly according to claim 7, wherein said remotely controlled vehicle is a car and said at least one secondary vehicle is a car having generally the same shape and appearance.

* * * * *